US005080280A

United States Patent [19]

Kraus

[11] Patent Number: 5,080,280

[45] Date of Patent: Jan. 14, 1992

[54] FOLDED SLEEVE

[75] Inventor: Rudolf Kraus, Osterreinen, Fed. Rep. of Germany

[73] Assignee: Lever Brothers Company, Division of Conopco, Inc., New York, N.Y.

[21] Appl. No.: 439,046

[22] PCT Filed: Mar. 16, 1989

[86] PCT No.: PCT/EP89/00276

§ 371 Date: Nov. 1, 1989

§ 102(e) Date: Nov. 1, 1989

[87] PCT Pub. No.: WO90/09846

PCT Pub. Date: Sep. 7, 1990

[51] Int. Cl.[5] ..... B65D 5/02

[52] U.S. Cl. ..... 229/40; 206/434

[58] Field of Search ..... 229/40, 182.1; 206/434

[56] References Cited

U.S. PATENT DOCUMENTS

| | | | |
|---|---|---|---|
| 3,356,283 | 12/1967 | Champlin . | |
| 3,367,557 | 2/1968 | Farquhar | 229/40 |
| 3,750,363 | 8/1973 | Wood . | |
| 4,077,095 | 3/1978 | Oliff . | |
| 4,131,230 | 12/1978 | Koehlinger et al. . | |
| 4,609,143 | 9/1986 | Collura et al. | 229/40 |
| 4,723,699 | 2/1988 | Brown et al. . | |
| 4,749,123 | 6/1988 | Ganz | 229/40 |
| 4,773,540 | 9/1988 | Schuster | 229/40 |
| 4,880,115 | 11/1989 | Chaussadas | 229/40 |
| 4,925,019 | 5/1990 | Ganz et al. | 229/40 |

*Primary Examiner*—Stephen Marcus
*Assistant Examiner*—Christopher McDonald
*Attorney, Agent, or Firm*—Ronald A. Koatz

[57] ABSTRACT

Folded sleeve for several objects arranged in two rows next to each other, with a top panel, two side panels and a base consisting of two sections. Tabs are cut out of one base section which engage openings in the other base section and lock with further tabs there.

2 Claims, 2 Drawing Sheets

FIG.2
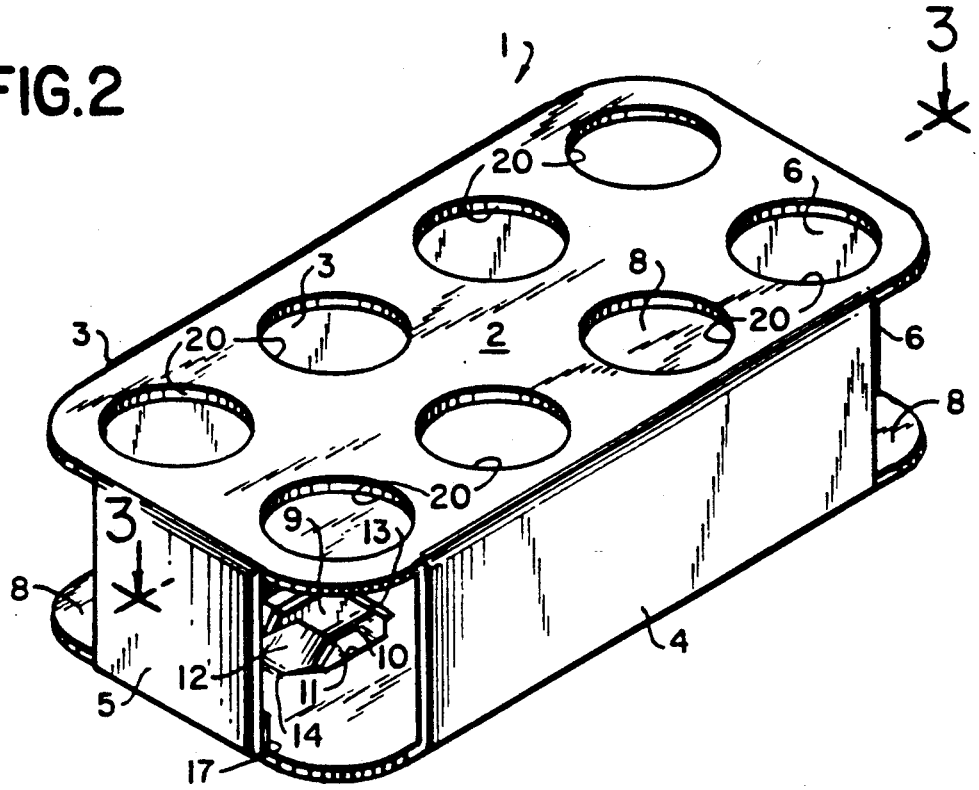
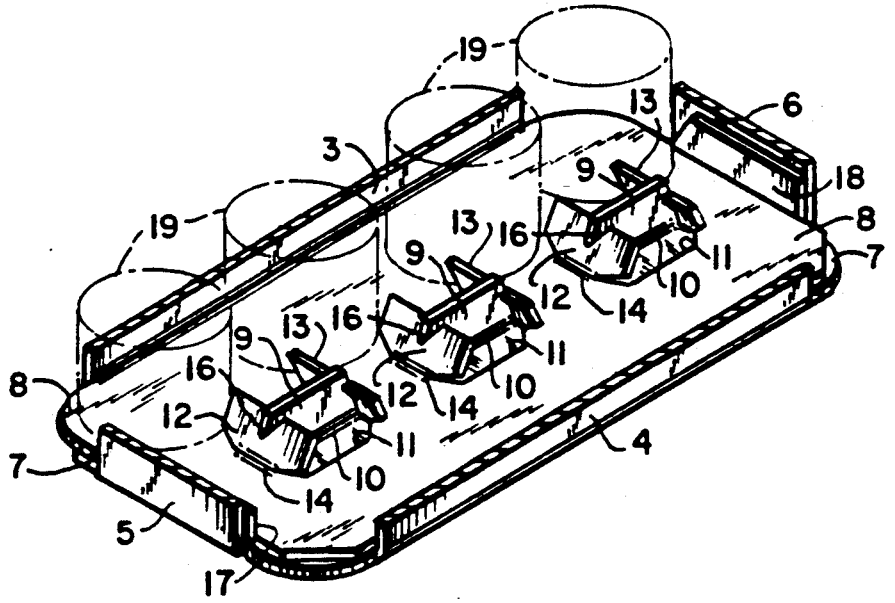
FIG.3

FOLDED SLEEVE

The invention relates to a folded sleeve for several objects arranged in two rows next to each other, with a top panel, two side panels and a base consisting of two sections that are attached together to close the folded sleeve. Such folded sleeves are used to package yoghurt tubs or similar objects that need to be held securely.

In the solution proposed by the invention, openings are provided in the inner base section, which tabs die-cut from the other outer base section engage and lock with.

Although these tabs hold the two base sections together, their primary purpose is to guarantee that the bases of the objects in the folded sleeve and held securely.

In a very advantageous embodiment of the invention at least one tab, which is hinged to the edge of an opening and is provided with a cut that the tab of the outer base section engages, is provided on the openings of the inner base section. This is a very simple way to lock the tab of the outer base section.

In a particularly favourable further development of the object of the invention, two tabs that face each other are provided in each opening of the inner base section and have cuts which the edges of the tabs of the outer base section engage.

Locking the external tab in two internal tabs fixes the external tab in place fully effectively and holds the objects in the sleeve extremely securely.

A further improvement in the security with which the objects in the sleeve are held is achieved if in accordance with the invention single flaps are hinged to both the top panel and the outer base section at the two ends of the folded sleeve, the flaps at each end overlapping at least slightly. This has the effect of fixing the base and top panel in relation to each other, with the result that the locking of the tabs is also made even more secure.

One embodiment of the invention is shown in the drawing:

FIG. 2 shows a folded sleeve erected from the blank illustrated in FIG. 1.

Figure 1:
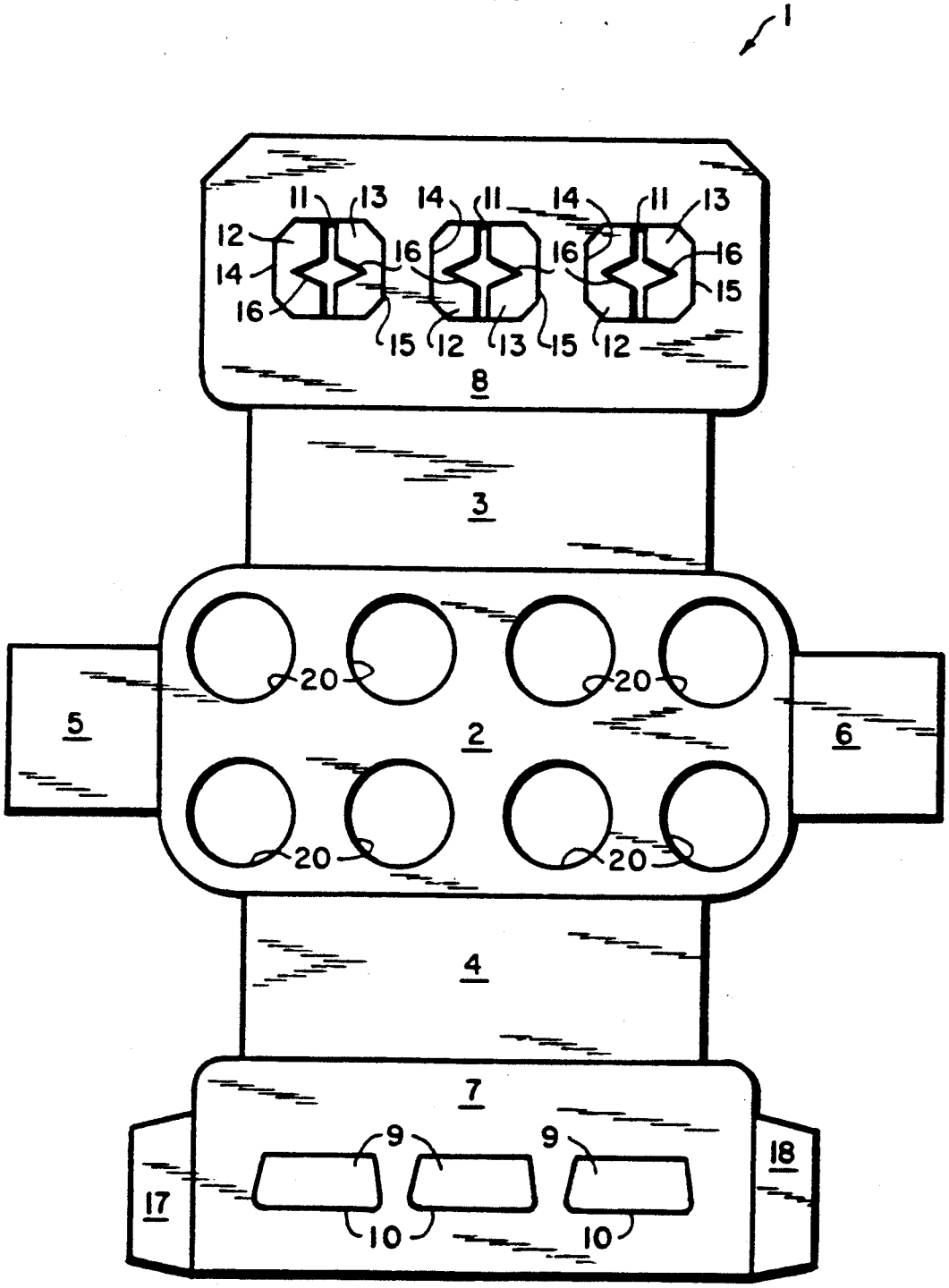
FIG. 1 shows a flat board blank.

FIG. 3 shows how tabs 9 in FIG. 1 engage the fold-open openings defined by opening 11 and wedge shaped cut 16.

1 in FIG. 1 is a flat board blank which has a top panel 2 to which two side panels 3 and 4 are hinged. The top panel 2 also has two flaps 5 and 6 that serve to form end panels. A base section 7/8 is hinged to each of the two side panels 3 and 4. Three tabs 9 are cut out of the base section 7 and are hinged to the base section along a folding line 10.

The base section 8, on the other hand, has three openings 11 in each of which two tabls 12, 13 are located that are attached to the base section along the bending lines 14/15. Both tabs 12/13 have wedge-shaped cuts 16 which are in alignment with each other and the openings of which face each other.

Two relatively short flaps 17/18, which are joined to the flaps 5 and 6 when the sleeve is erected, are hinged to the sides of base section 7. The base is formed by placing the two base sections 7 and 8 on top of each other, the section 7 being located on the outside and the section 8 on the inside, both of them being glued together.

The tabs 9 are pressed inwards, pushing with them the tabs 12 and 13, which rest against the tubs in the pack. In their final position the tabs 9 engage the cuts 16, as a result of which the tabs lock together and hold the lower section of the tabs 9 in a position.

Eight circular holes 20, the purpose of which is to enable the lids of the tubs 19 to be seen, have been cut out of the top panel 2 in the embodiment shown.

I claim:

1. A folded sleeve for holding and securing several packaging containers which containers have an essentially circular base area and are arranged in two rows next to each other wherein said folded sleeve comprises a top panel hinged to two side panels, one of which side panels (3) is hinged to an inner base section (8) and one of which side panels (4) is hinged to an outer base section (7), said two base sections overlapping each other to some extent when the folded sleeve is closed;

said inner base section comprising a series of fold-open openings wherein each opening is defined by two tabs (12 and 13) each of which tab is hinged to a bending line (14 and 15) wherein the two bending lines run parallel to each other and wherein each of said fold-open openings is further defined by an opening (11) running between the tabs and parallel to the bending lines and by a wedge-shaped cut (16) located at about the center of the opening;

said outer base section comprising a series of table (9) each hinged to a bending line (10), each one of which tabs corresponds to and is designed to engage the fold-open openings in the inner base section;

wherein the wedge shaped out of the inner base section runs parallel to the bending line on the outer base section and wherein the tabs of the outer base section (9) are designed to engage and lock with the wedge-shaped cut (16) in a way that the side edges of the tabs on the inner base section (12 and 13) rest against the lower section of the packaging containers when the tabs are in an erected position.

2. A folded sleeve according to claim 1 further comprising two flaps (5 and 6) hinged to the top panel and two flaps (17 and 18) hinged to the upper base section.

* * * * *